US010401073B2

(12) United States Patent
Hu

(10) Patent No.: US 10,401,073 B2
(45) Date of Patent: Sep. 3, 2019

(54) REFRIGERATOR HAVING A THERMOELECTRIC MODULE

(71) Applicant: LG ELECTRONICS INC., Seoul (KR)

(72) Inventor: Jinseok Hu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 164 days.

(21) Appl. No.: 14/715,120

(22) Filed: May 18, 2015

(65) Prior Publication Data

US 2015/0330678 A1 Nov. 19, 2015

(30) Foreign Application Priority Data

May 16, 2014 (KR) ..... 10-2014-0058823

(51) Int. Cl.
*F25C 5/20* (2018.01)
*F25B 21/02* (2006.01)

(52) U.S. Cl.
CPC ..... *F25C 5/22* (2018.01); *F25B 21/02* (2013.01); *F25B 2321/0212* (2013.01); *F25B 2321/0251* (2013.01)

(58) Field of Classification Search
CPC .. F25C 5/005; F25B 2321/0212; F25B 21/02; F25B 2321/02
USPC ..... 62/3.6
See application file for complete search history.

(56) References Cited

U.S. PATENT DOCUMENTS

2010/0126185 A1* 5/2010 Cho ..... F25C 5/22 62/3.63
2011/0146323 A1* 6/2011 Choi ..... F25D 23/04 62/340
2011/0162392 A1* 7/2011 Lim ..... F25D 29/00 62/66
2012/0096872 A1* 4/2012 Cheong ..... F25D 23/025 62/3.3
2012/0312030 A1* 12/2012 Lu ..... F25B 21/02 62/3.6
2013/0086923 A1* 4/2013 Petrovski ..... H01L 35/00 62/3.61
2013/0227983 A1* 9/2013 Jeong ..... F25D 23/061 62/285

FOREIGN PATENT DOCUMENTS

CA 2 838 199 A1 12/2012
EP 1821051 A1 * 8/2007 ..... F25B 21/02
EP 2 444 761 A2 4/2012
KR 1019930023676 A 12/1993
KR 1020110072365 A 6/2011
KR 1020120040891 A 4/2012

* cited by examiner

*Primary Examiner* — Frantz F Jules
*Assistant Examiner* — Steve S Tanenbaum
(74) *Attorney, Agent, or Firm* — Dentons US LLP

(57) ABSTRACT

Provided is a refrigerator. A thermoelectric module is disposed on a top surface of an ice compartment defined in a refrigerator door to discharge hot air through a cap deco disposed on a top surface of the door so that efficient ice making in the ice compartment is realized independently from a refrigeration cycle.

12 Claims, 6 Drawing Sheets

REFRIGERATOR HAVING A THERMOELECTRIC MODULE

CROSS-REFERENCE TO RELATED APPLICATIONS

The present application claims priority under 35 U.S.C. 119 and 35 U.S.C. 365 to Korean Patent Application No. 10-2014-0058823 (May 16, 2014), which is hereby incorporated by reference in its entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated into a refrigeration cycle to store foods in an optimum state.

The inside of the refrigerator may be classified into a refrigerating compartment and a freezing compartment. Receiving members such as shelves, drawers, and baskets may be disposed within the refrigerating compartment and the freezing compartment. Also, the refrigerating compartment and the freezing compartment may be closed by a door. The refrigerator is classified into various types according to positions of the refrigerator compartment and the freezer compartment and configurations of the doors.

The refrigerator tends to increase in size more and more, and multi-functions are provided to the refrigerator as dietary life changes and pursues high quality, and accordingly, refrigerators of various structures in consideration of user convenience are brought to the market.

For example, the refrigerator may include an ice making device for making ice. The refrigerator may further include a dispenser for dispensing the made ice to the outside thereof. The ice making device may be provided in a door of the refrigerator to improve user's convenience or efficient use of a storage space. The ice making device may make ice in a space of the refrigerator by using cool air to store the made ice.

However, to make ice in the refrigerator having the above-described structure, it may be necessary to provide a passage or structure for supplying cool air within the refrigerator. Also, in order to make ice, it may be necessary to drive a refrigeration cycle regardless of a state within the refrigerator.

To solve the above-described limitations, a structure in which an insulation space for accommodating an ice making device is defined in a door of a refrigerator, and a thermoelectric module is provided in the insulation space to cool the inside of the insulation space, thereby making ice in the ice making device disposed in the insulation space is disclosed in Korean Patent Registration No. 10-0814687 and Korean Patent Publication No. 10-2010-0057216.

However, in the structure of the refrigerator, a heat dissipation side of the thermoelectric module may be exposed to the inside of the refrigerator to deteriorate cooling efficiency within the refrigerator. In addition, since a structure of discharging hot air of the heat dissipation side of the thermoelectric module is not provided, there is difficulty in effective cooling.

SUMMARY

Embodiments provide a refrigerator in which a thermoelectric module is disposed on a top surface of an ice compartment provided in a refrigerator door to discharge hot air through a cap deco disposed on a top surface of the door so that efficient ice making in the ice compartment is realized independently from a refrigeration cycle.

In one embodiment, a refrigerator includes: a cabinet defining a storage space; and a door opening and closing the storage space; wherein the door includes: an outer case having a plate shape, the outer case defining an outer confirmation of the door; a door liner coupled to the outer case to define a configuration of a rear surface of the door, the door liner being recessed inward to define an ice compartment that is an insulation space in which an ice making assembly for making and storing ice is accommodated; a door cap deco coupled to upper ends of the outer case and the door liner to define a top surface of the door; and a thermoelectric module disposed in the ice compartment, the thermoelectric module having a heat absorption side for cooling the ice compartment and a heat dissipation side that is exposed to the outside of the door to independently cool the ice compartment.

The ice compartment may be opened toward the inside of the refrigerator, and an ice compartment door for opening and closing the ice compartment may be further disposed on the door liner.

An opening on which the thermoelectric module is mounted may be defined in the door liner defining a top surface of the ice compartment, and the heat dissipation side may be disposed above the opening, and the heat absorption side may be disposed below the opening.

A heatsink plate may be disposed on the heat dissipation side of the thermoelectric module, and the heatsink plate may be mounted on the door cap deco.

The door cap deco may include: a deco groove recessed from the door cap deco to guide hot air discharged from the heat dissipation side upward; and a deco hole defined inside the deco groove, the deco hole being opened at a position corresponding to the heat dissipation side of the thermoelectric module.

An opening may be defined in the door liner, which corresponds to a position on which the thermoelectric module is mounted, and the deco hole may be defined directly above the opening in the door cap deco.

A dispenser disposed below the ice compartment to dispense ice to the outside may be disposed in the door.

A voltage inputted into the thermoelectric module to cool the ice compartment may be inputted in a state where a level of the voltage is reduced by a step down converter.

A voltage inputted into the thermoelectric module to cool the ice compartment may be controlled in mean voltage by a duty control manner in which the input voltage is turned on or off for a predetermined time.

The heat dissipation side of the thermoelectric module may be exposed through the top surface of the door.

The heat dissipation side of the thermoelectric module may be disposed on the cap deco defining the top surface of the door, and the cap deco may have a front end that extends upward from the heat dissipation side of the thermoelectric module.

The thermoelectric module may be mounted on a top surface of the ice compartment above the ice making assembly.

A blower fan for supplying cool air into the ice making assembly may be further disposed on the heat absorption side.

The door may have a front surface that extends upward from an upper end of the heat dissipation side.

An opening communicating with the ice compartment may be defined in the door, and the thermoelectric module may cover the opening of the door to partition the inside and the outside of the ice compartment.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The technical scope of the embodiments will fall within the scope of this disclosure, and addition, deletion, and modification of components or parts are possible within the scope of the embodiments.

That is, for convenience of understanding and description, although a bottom freezer type refrigerator in which a freezing compartment is disposed at a lower side and a refrigerator including a French type door in which a pair of doors are disposed on both left and right sides are described as an example in the current embodiment, the present disclosure is not limited thereto. For example, the features according to the current embodiment may be applied to all types of refrigerators in which an ice compartment is defined in a refrigerator door, and a top surface of the door is exposed to the outside.

Figure 1:
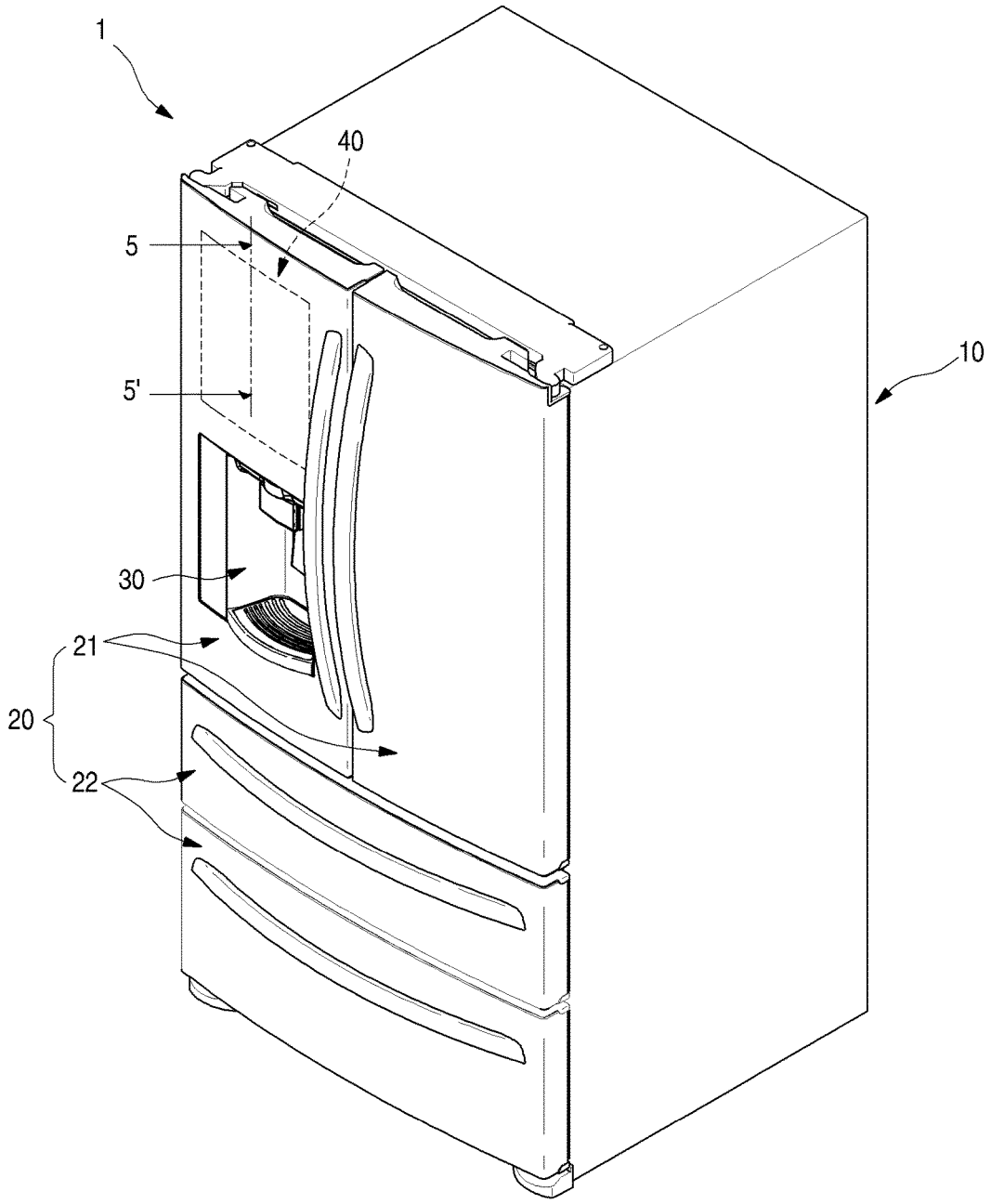
FIG. 1 is a perspective view of a refrigerator according to an embodiment.
Figure 2:
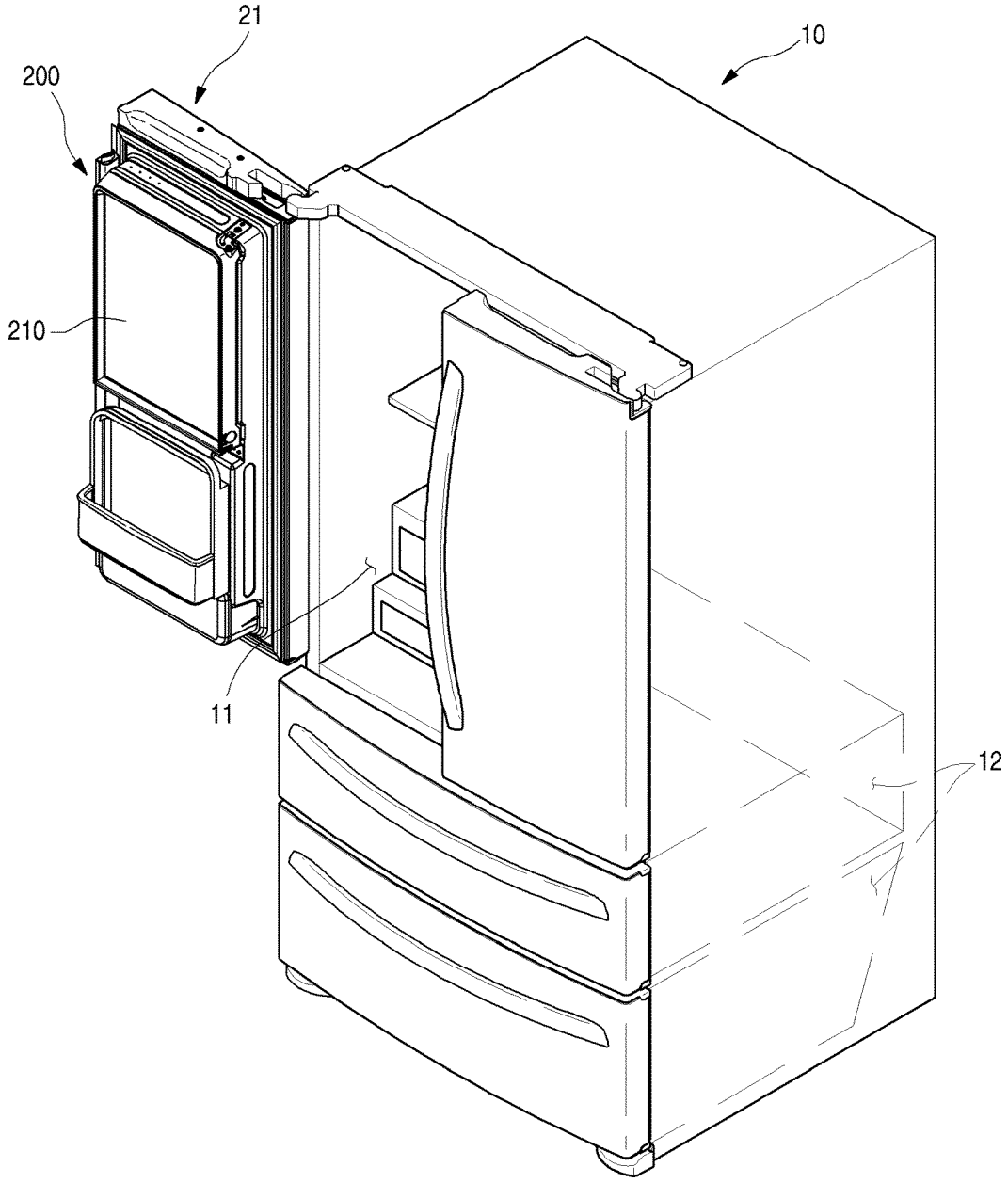
FIG. 2 is a perspective view of the refrigerator with a door opened.

FIG. 1 is a perspective view of a refrigerator according to an embodiment. FIG. 2 is a perspective view of the refrigerator with a door opened.

A refrigerator 1 according to an embodiment includes a cabinet 10 defining an outer appearance of the refrigerator 1 and a refrigerator door 20 movably connected to the cabinet 10.

A storage compartment for storing foods is defined in the cabinet 10. The storage compartment includes a refrigerating compartment 11 and a freezing compartment 12 disposed under the refrigerating compartment 11.

That is, a bottom freeze type refrigerator in which a refrigerating compartment is disposed above a freezing compartment will be described as an example in the current embodiment.

The refrigerator door 20 includes a refrigerating compartment door 21 for opening and closing the refrigerating compartment 11 and a freezing compartment door 22 for opening and closing the freezing compartment 12.

The refrigerating compartment door 21 may include a pair of doors disposed on both left and right sides. The refrigerating compartment door 21 disposed on each of both left and right sides may be rotatably mounted on the cabinet 10 to independently open and close an opened front surface of the refrigerating compartment 11.

The freezing compartment door 22 may include a plurality of doors that are vertically disposed. The freezing compartment door 22 may have a drawer shape. Thus, when the freezing compartment door 22 is withdrawn, a basket accommodating foods may be withdrawn together with the freezing compartment door 22, and thus an accommodation space may be exposed upward. The freezing compartment door 22 may be provided in a pair. The pair of freezing compartment doors 22 may be independently and slidably withdrawn or inserted to open or close the inside of the freezing compartment 12. Here, the freezing compartment 12 may be partitioned into a plurality of spaces to provide a storage space having a different temperature such as a switching compartment or the refrigerating compartment.

Also, a dispenser 30 for dispensing water or ice may be disposed in one of the pair of refrigerating compartment doors 21. In the current embodiment, the dispenser 30 and an ice making assembly 40 for making and storing ice may be provided in the refrigerating compartment 21 that is disposed a left side (when viewed in FIG. 1).

The refrigerating compartment door 21 includes an outer case 110, a door liner 120 coupled to the outer case 110, and a door cap deco 130 coupled to each of upper and lower ends of the refrigerating compartment door 21. The door liner 120 defines a rear surface of the refrigerating compartment door 21.

The door liner defines an ice compartment 200. The ice making assembly 40 for making and storing ice is disposed in the ice compartment 200. Also, the ice compartment 200 is opened and closed by an ice compartment door 210. The ice compartment door 210 is rotatably connected to the door liner 120 through a hinge 211.

Also, a handle 212 that is manipulated to restrict the door liner 120 so that the ice compartment door 210 maintains the closed state of the ice compartment 200 is disposed on the ice compartment door 210. A handle restriction part 213 to which a portion of the handle 212 is coupled is disposed on the door liner 120. The handle restriction part 213 accommodates a portion of the handle 212.

A gasket 214 is disposed on a circumference of a front surface (a surface facing the inside of the ice compartment) of the ice compartment door 210. The gasket 214 may contact an opened front end of the ice compartment 200 to seal the ice compartment 200.

The door liner 120 may define the rear surface of the refrigerating compartment door 21 in addition to the ice compartment 200. The door liner 120 may be coupled to the outer case 110 to define an overall configuration of the refrigerating compartment door 21. Also, in the state where the outer case 110 and the door liner 120 are coupled to each other, an insulation material may be filled to thermally insulate the inside of the refrigerating compartment 11 and the inside of the ice compartment 200. The door cap deco 130 may be mounted on each of upper and lower ends of the refrigerating compartment door 21 to define top and bottom surfaces of the refrigerating compartment door 21.

The structures of the outer case 110, the door liner 120, and the door cap deco 130 may be equally applied to other doors.

Figure 3:
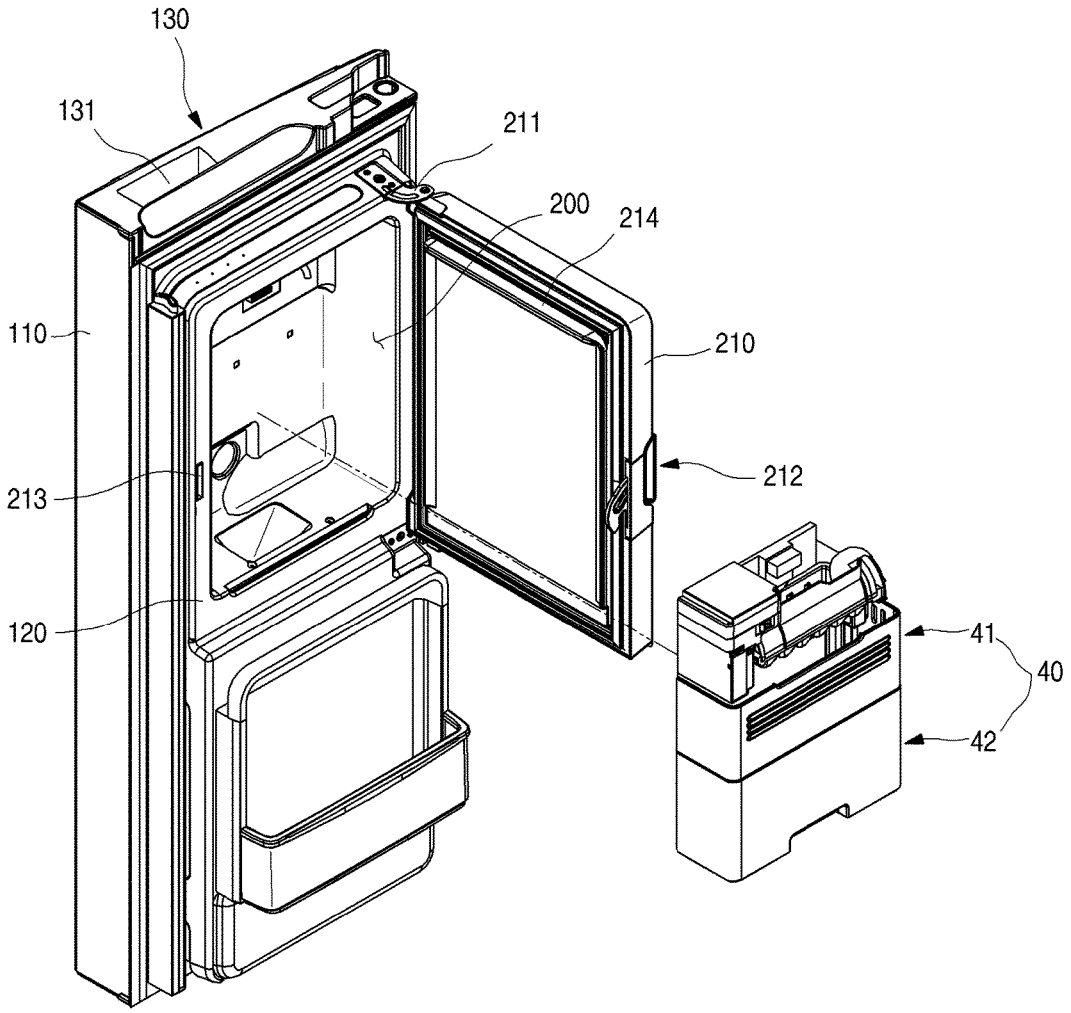
FIG. 3 is an exploded perspective view illustrating an ice compartment of the door.
Figure 4:
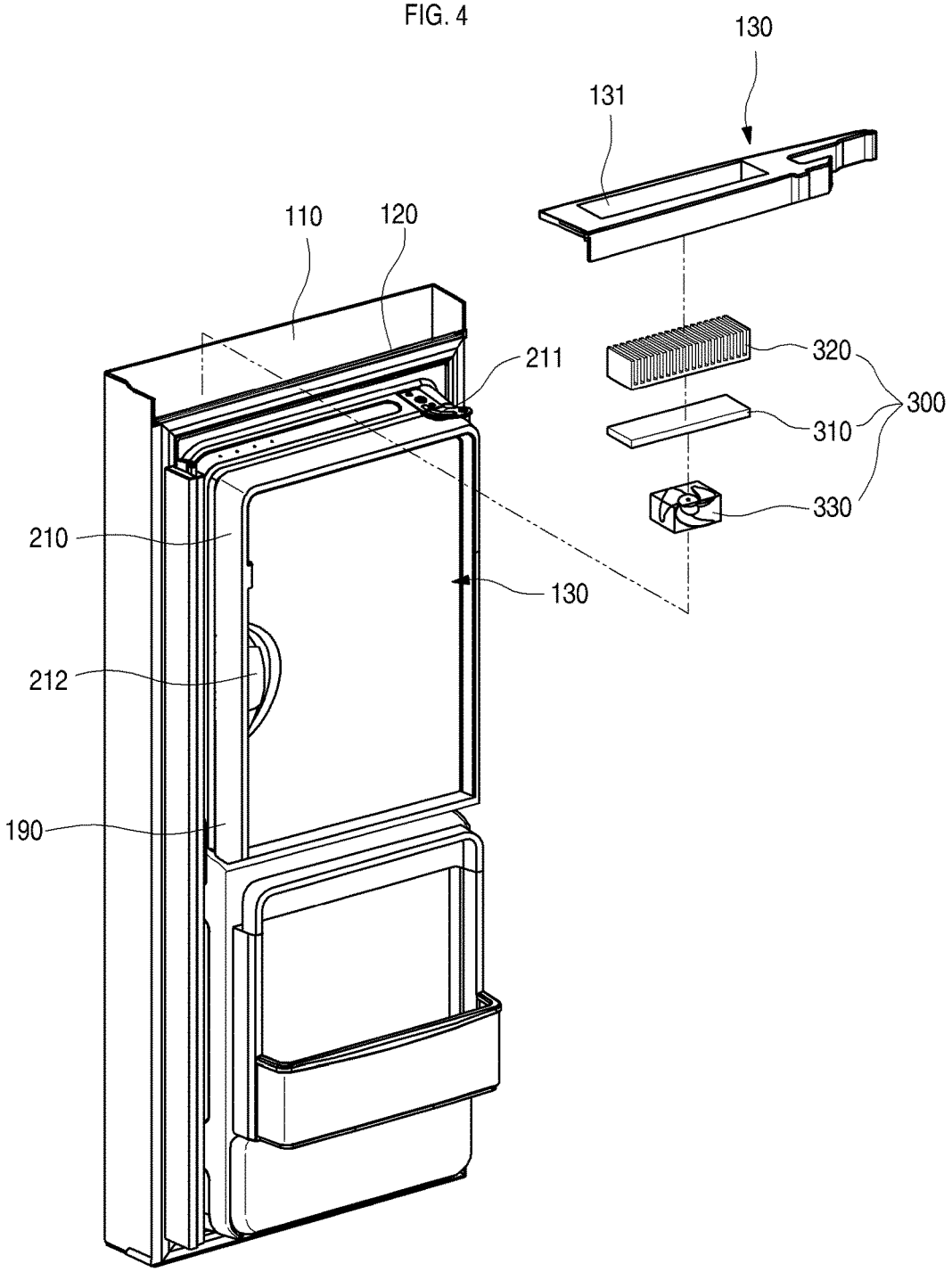
FIG. 4 is an exploded perspective view illustrating a coupling structure of a cooling assembly according to an embodiment.
Figure 5:
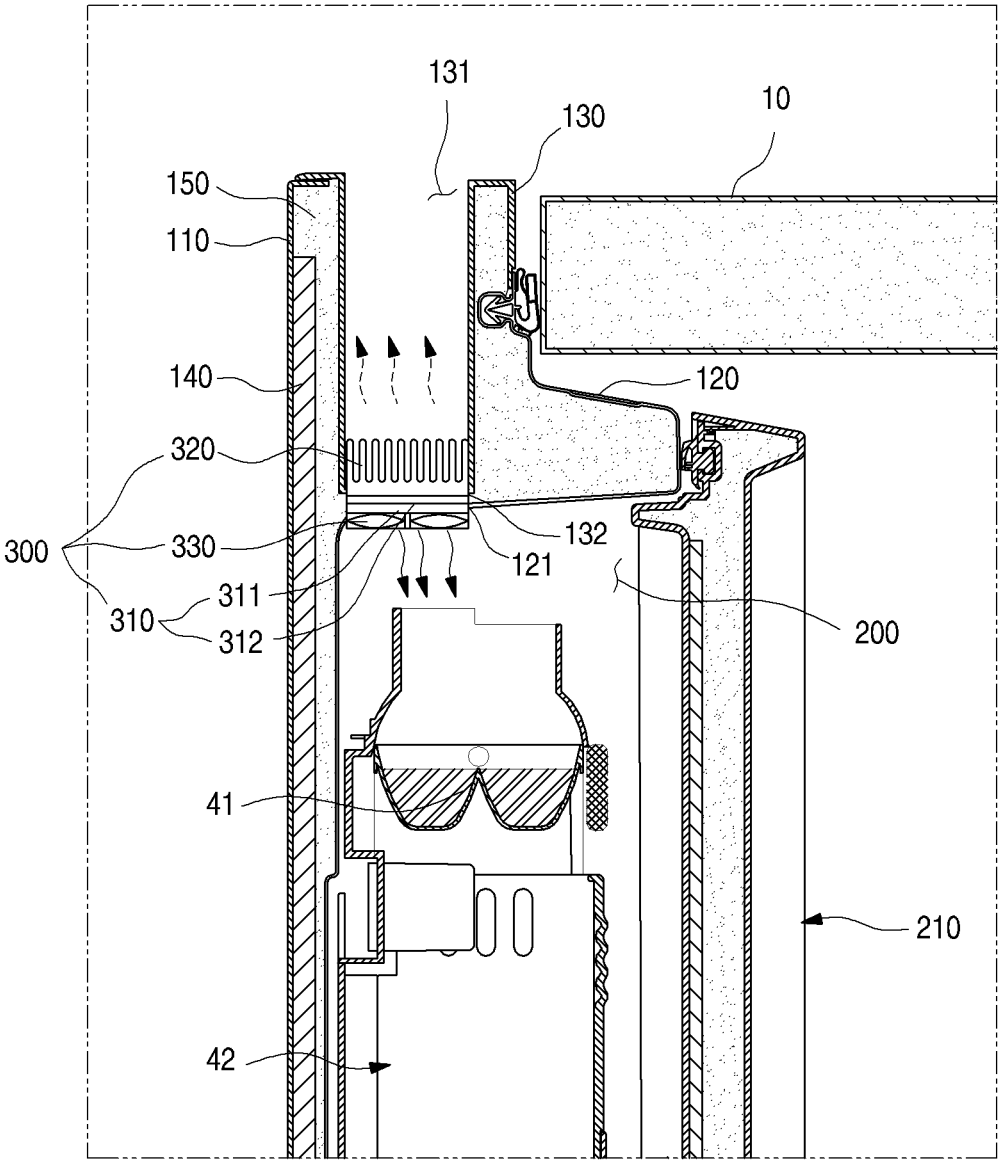
FIG. 5 is a cross-sectional view taken along line 5-5' of FIG. 1.

FIG. 3 is an exploded perspective view illustrating the ice compartment of the door. FIG. 4 is an exploded perspective view illustrating a coupling structure of a cooling assembly according to an embodiment. FIG. 5 is a sectional view taken along line 5-5' of FIG. 1.

The refrigerating compartment door 21 will be described in more detail with reference to the drawings. The door liner 120 may be recessed from the rear surface of the refrigerating compartment door 21 to define the ice compartment 200 that is capable of accommodating the ice making assembly 40. The ice compartment 200 has an opened front surface and is opened or closed by the ice compartment door 210 that is thermally insulated.

The ice making assembly 400 may make ices to store the made ice. The ice making assembly may include an ice maker 41 for making ice and an ice bank 42 for storing the ice made in the ice maker 41. The ice maker 41 and the ice bank 42 may be detachably mounted. Also, the ice maker 41 and the ice bank 42 may be independently mounted on the inside of the ice compartment 200.

The ice maker 41 may include an automatic ice maker 41 by which water supply and ice transfer are automatically performed. The ice bank 42 may be configured to supply the stored ice into the dispenser 30.

A cooling unit 300 for cooling the ice compartment 200 is mounted on the top surface of the ice compartment 200. Also, an opening 121 is defined in the door liner 120 defining the top surface of the ice compartment 200 so that the cooling unit 300 is mounted through the opening 121. The opening 121 may communicate with a deco groove 131 of the door cap deco 130 and be opened toward an upper side of the refrigerating compartment door 21.

The cooling unit 300 may be configured to cool the ice compartment 200. The cooling unit 300 may include a thermoelectric module 310 that is capable of cooling the ice compartment 200 by using a peltier effect. Thus, the inside of the ice compartment 200 may be independently cooled without introducing cool air into the ice compartment 200 by the refrigeration cycle.

The cooling unit 300 may include the thermoelectric module 310 for cooling the inside of the ice compartment 200, a heatsink plate 320 contacting a top surface of the thermoelectric module 310 to dissipate heat, and a blower fan 330 for smoothly transferring the cool air generated by the thermoelectric module 310 into the ice compartment 200. The heatsink plate may also be disposed on a heat absorption side 311 of the thermoelectric module 310. The blower fan 300 may also be disposed on side of the heatsink plate to more effectively perform heat exchange.

The thermoelectric module 310 may be fixedly mounted on the opening 121. Here, the heat absorption side 311 may face the inside of the ice compartment 200, and a heat dissipation side 312 of the thermoelectric module 310 may face the outside of the ice compartment 200. Thus, when a power is applied to the thermoelectric module 310, the ice compartment 200 may be cooled by the continuous heat absorption. Hot air of the heat dissipation side 312 may be discharged upward through the door cap deco 130.

The thermoelectric module 310 may be mounted on the door linear 120 to correspond to the configuration of the opening 121. An insulation material 150 may be disposed between the outer case 110 and the door liner 120 in addition to a circumferential of the opening 121.

Also, the heatsink plate 320 is mounted on the heat dissipation side 312 of the thermoelectric device 310. The heatsink plate 320 may protrude to the outside through the opened deco hole 132 of the door cap deco 130 and be disposed in a deco groove 131 defined in the door cap deco 130. Thus, the heatsink plate 320 may be exposed to external air, and thus heat may be naturally released to the outside of the refrigerator.

The blower fan 330 may be further disposed inside the ice compartment 200 as necessary. The blower fan 330 may be disposed adjacent to the heat absorption side 311 of the thermoelectric module 310 to uniformly supply the cool air generated in the heat absorption side 311 into the ice compartment 200.

The door cap deco 130 may contact upper ends of the outer case 110 and the door liner 120. The deco hole 132 defined in a position corresponding to that on which the thermoelectric module 310 is mounted is defined in the door cap deco 130. Also, the deco groove 131 may be recessed downward from the door cap deco 130. Thus, the hot air generated when the heatsink plate 320 releases heat may flow to the opened upper side along the front surface of the deco groove 131, but does not flow to a front side.

Thus, the hot air generated when the thermoelectric module 310 operates may not have an influence on the cooling performance or heat exchange cycle within the refrigerator. In addition, transfer of the hot air to the user standing up at the front side of the refrigerator may be prevented.

A vacuum insulation material 140 may be further provided on an inner surface of the outer case 110 corresponding to a region of the ice compartment 200. The thermoelectric module 310 and the ice compartment 200 may be disposed to supplement a portion at which the filling of the foaming insulation material 150 is insufficient, thereby improving the insulation performance.

Hereinafter, an operation of the refrigerator including the above-described constitutions according to an embodiment will be described.

A refrigerant circulating into the refrigeration cycle may be heat-exchanged with air within the refrigerator in an evaporator to cool the inside of the refrigerator. The cool air generated in the evaporator may be supplied into the refrigerating compartment 11 and the freezing compartment 12 through a passage within the refrigerator to cool the spaces within the refrigerator. Here, the supply of the cool air may be adjusted by a damper to maintain the inside of the refrigerator at a preset temperature.

In case of the ice compartment 200, water for making ice may be supplied into the ice maker 41 to make ice. The inside of the ice compartment 200 may be cooled by the operation of the cooling unit so as to make ice.

In detail, when a power is applied to the thermoelectric module 310, the heat absorption side 311 of the thermoelectric module 310 may be cooled, and the heat dissipation side 312 may be heated. The cool air generated by the cooling of the heat absorption side 311 may uniformly cool the entire region of the ice compartment 200 by the operation of the blower fan 330. Also, the inside of the ice compartment 200 may be maintained to a temperature at which ice is made.

Simultaneously, the heat dissipation side 312 may be heated. Here, the generated hot air may be heat-exchanged with external air through the heatsink plate 320. That is, the hot air may be discharged upward through the heatsink plate 320 that is exposed to the deco groove 131 of the door cap deco 130.

That is, the cooling of the thermoelectric module 310 may be completely performed within the ice compartment 200. Also, the ice compartment 200 may be completely separated from the refrigerating compartment 11 or the freezing compartment 12 to discharge heat generated in the thermoelectric module 310 to the outside.

Thus, the cooling of the ice compartment 200 may be independently performed with respect to the refrigeration cycle of the refrigerator 1, and also, any operation that is capable being deteriorating the cooling efficiency of the refrigerator 1 may not be performed.

The ice made in the ice maker 41 may be transferred by an ejector of the ice maker 41 to drop down and then be stored in the ice bank 42.

Also, when the user manipulates the dispenser 30, the ice stored in the ice bank 42 may be dispensed to the outside through the dispenser 30.

Figure 6A:
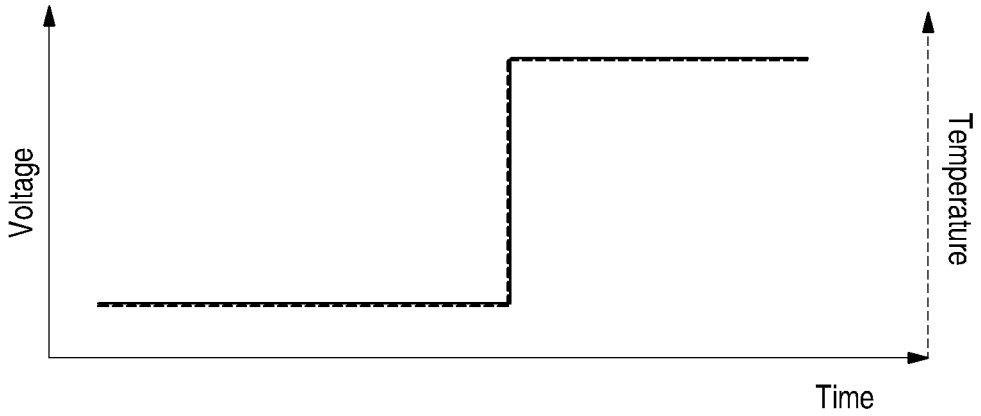
FIGS. 6A and 6B are graphs illustrating a variation in temperature depending on an input voltage of a thermoelectric module that is a main part of the refrigerator according to an embodiment.
Figure 6B:
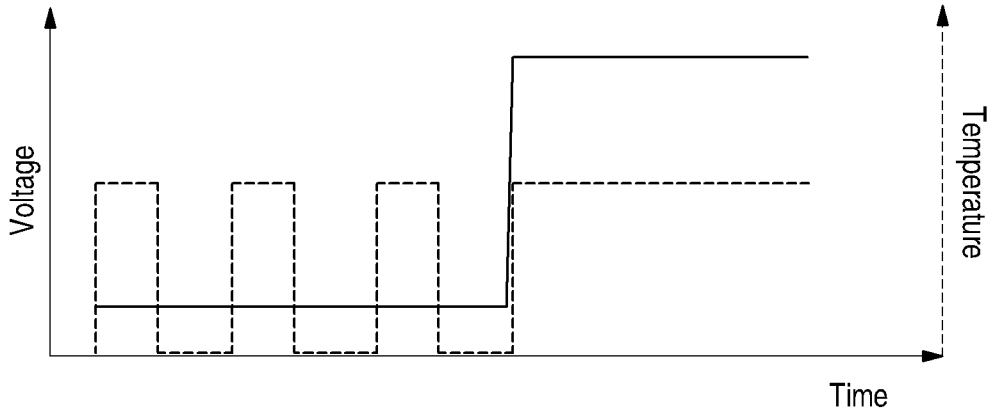

FIGS. 6A and 6B are graphs illustrating a variation in temperature depending on an input voltage of the thermoelectric module that is a main part of the refrigerator according to an embodiment.

Referring to FIGS. 6A and 6B, a power applied to the thermoelectric module 310 may be an AC power. Thus, an input power may be converted into a DC power through full bridge and then applied to the thermoelectric module 310. Here, the input voltage may be controlled in intensity to adjust a cooling capacity so that the heat absorption side 311 has a desired temperature.

To adjust the required cooling capacity, as illustrated in FIG. 6A, the input power inputted into the thermoelectric module 310 may reduce a level of the power applied to the thermoelectric module 310 by using a step down converter to reduce an inner temperature of the ice compartment 200. The power passing through the step down converter may be inputted into the thermoelectric module 310 in the down level to reach a temperature that is required for the heat absorption side 311, thereby cooling the ice compartment 200 to make ice. Also, when the inside of the ice compartment 200 reaches a preset temperature, the inputted voltage may increase in level again. Thus, the heat absorption side 311 may increase in temperature.

Also, to adjust the required cooling capacity, as illustrated in FIG. 6B, a level of the voltage inputted into the thermoelectric module 30 may be equally maintained. Then, to reduce the inner temperature of the ice compartment 200, the input voltage may be repeatedly turned on and off through duty control to reduce a mean voltage of the input voltage. As described above, in the state where the mean voltage of the voltage inputted into the thermoelectric module 310 is reduced, the heat absorption side 311 may decrease in temperature, and thus, the inside of the ice compartment 200 may be cooled to make ice. Also, after the inner temperature of the ice compartment 200 reaches the preset temperature, or a preset time elapses, the input voltage may be maintained in the turn-on state. Thus, the heat absorption side 311 may increase in temperature again.

In the refrigerator according to the embodiment, since the cooling unit for cooling the inside of the ice compartment defining the insulation space is constituted by the thermoelectric module, it may be unnecessary to supply the cool air into the ice compartment from the outside.

Thus, since the inside of the ice compartment independent from the refrigeration cycle of the refrigerator is cooled to make ice, the cooling efficiency within the refrigerator and the ice making efficiency may be improved.

Also, the thermoelectric module may be disposed on the upper end of the ice compartment, and the heatsink plate may be disposed on the door cap deco defining the upper end of the refrigerator door. Thus, the heat generated when the thermoelectric module is driven may be discharged upward through the door cap deco. Here, the discharged heat may be guided through the deco groove of the door cap deco and then discharged upward so that the discharged heat does not have an influence on the user standing up at the front side of the refrigerator.

Also, since the heat dissipation side of the thermoelectric module is exposed to the outside of the refrigerator, the performance efficiency of the thermoelectric module may be improved. In addition, the refrigerator may be operable in the state where a change in temperature within the refrigerator and deterioration in cooling performance of the refrigerator do not occur.

Also, the cooling unit may be disposed on the top surface of the ice compartment that is recessed from the rear surface of the refrigerator door. In addition, the cooling unit may be mounted on a position that passing through the door deco. Therefore, the cooling unit may be mounted while maintaining the slim door.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet defining a storage space; and a door that opens and closes the storage space;

wherein the door comprises:

an outer case defining an outer configuration of the door;

a door liner coupled to the outer case, the door liner defining a configuration of a rear surface of the door, wherein the door liner is recessed inward and defines an ice compartment that is an insulation space that accommodates an ice making assembly for making and storing ice;

a door cap deco coupled to upper ends of the outer case and the door liner, the door cap deco defining a top surface of the door; and a thermoelectric module disposed in the ice compartment, the thermoelectric module comprising a heat absorption side for cooling the ice compartment and a heat dissipation side that is exposed to the outside of the door to independently cool the ice compartment, wherein the door liner comprises an opening formed at a position corresponding to a top portion of the ice compartment, whereby the thermoelectric module is mounted within the opening and an insulation material is disposed entirely outside of the opening and circumferential of the opening, and the heat dissipation side of thermoelectric module is disposed above the opening, and the heat absorption side of the thermoelectric module is disposed below the opening, and wherein the door cap deco comprises:

a deco groove recessed from a top surface of the door cap deco to the top portion of the ice compartment, the deco groove being capable of having hot air discharged from the heat dissipation side of the thermoelectric module upward through the deco groove, a deco hole defined inside the deco groove, the deco hole being opened at a position corresponding to the heat dissipation side of the thermoelectric module, wherein the deco hole is formed at a bottom surface of the deco groove, the deco hole formed at a position corresponding to the opening, wherein the heat dissipation side of the thermoelectric module is disposed in the deco hole, wherein a fan for supplying cool air into the ice making assembly is disposed at the heat absorption side of the thermoelectric module, and wherein the ice making assembly comprises:

an ice maker, an ice bank for storing the ice made in the ice maker, and an inflow hole formed at an upper portion of the ice maker, and wherein the cool air supplied from the fan flows into the ice maker through the inflow hole, and wherein the cool air is introduced into the ice compartment independently of a refrigeration cycle for the refrigerator such that the ice compartment is independently cooled without introducing cool air therein by the refrigeration cycle, wherein a refrigerant circulating into the refrigeration cycle is heat-exchanged with air within the refrigerator in an evaporator to cool the inside of the refrigerator, and wherein the ice compartment is configured to open toward the inside of the refrigerator, wherein an ice compartment door configured to open and close the ice compartment is disposed on the door liner and inside of the refrigerator.

2. The refrigerator according to claim 1, wherein a heat sink plate is disposed on the heat dissipation side of the thermoelectric module, and the heat sink plate is mounted on the door cap deco.

3. The refrigerator according to claim 1, wherein the deco hole is defined above the opening in the door liner.

4. The refrigerator according to claim 1, further comprising a dispenser disposed in the door, wherein the dispenser dispenses ice to the outside of the door.

5. The refrigerator according to claim 1, further comprising a step down converter to reduce an inner temperature of the ice compartment, wherein the step down converter reduces a voltage inputted into the thermoelectric module in order to reduce an inner temperature of the ice compartment.

6. The refrigerator according to claim 1, wherein a voltage inputted into the thermoelectric module to cool the ice compartment is controlled in mean voltage by a duty cycle control in which the input voltage is turned on or off for a predetermined time.

7. The refrigerator according to claim 1, wherein the heat dissipation side of the thermoelectric module is exposed through the top surface of the door.

8. The refrigerator according to claim 1, wherein the heat dissipation side of the thermoelectric module is disposed on the door cap deco defining the top surface of the door, and the door cap deco has a front end that extends upward from the heat dissipation side of the thermoelectric module.

9. The refrigerator according to claim 1, wherein the thermoelectric module is mounted on a top surface of the ice compartment above the ice making assembly.

10. The refrigerator according to claim 1, wherein the door has a front surface that extends upward from an upper end of the heat dissipation side of the thermoelectric module.

11. The refrigerator according to claim 1, wherein the thermoelectric module covers the opening formed in the door to partition the inside and the outside of the ice compartment.

12. The refrigerator of claim 1, wherein the thermoelectric module corresponds to a configuration of the opening such that the thermoelectric module is in contact with a portion of the door liner that forms the opening.

* * * * *